US006843233B2

(12) United States Patent
Berger et al.

(10) Patent No.: US 6,843,233 B2
(45) Date of Patent: Jan. 18, 2005

(54) FUEL INJECTION SYSTEM

(75) Inventors: Werner Berger, Markgroeningen (DE); Martin Mueller, Moeglingen (DE); Andreas Glaser, Stuttgart (DE); Anh Tuan Hoang, Tamm (DE); Martin Buehner, Backnang (DE); Cedric Olivier, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/470,796

(22) PCT Filed: Sep. 23, 2002

(86) PCT No.: PCT/DE02/03600

§ 371 (c)(1),
(2), (4) Date: Jan. 21, 2004

(87) PCT Pub. No.: WO03/048562

PCT Pub. Date: Jun. 12, 2003

(65) Prior Publication Data

US 2004/0112339 A1 Jun. 17, 2004

(30) Foreign Application Priority Data

Nov. 30, 2001 (DE) ..... 101 58 787

(51) Int. Cl.[7] ..... F02M 55/02
(52) U.S. Cl. ..... 123/468; 123/469; 123/470
(58) Field of Search ..... 123/468, 469, 123/470, 467

(56) References Cited

U.S. PATENT DOCUMENTS

| | | | | | |
|---|---|---|---|---|---|
| 2,014,355 | A | | 9/1935 | Hussman | |
| 2,232,656 | A | * | 2/1941 | Davis | 428/609 |
| 2,407,745 | A | * | 9/1946 | Jacobson | 285/278 |
| 2,876,801 | A | * | 3/1959 | November | 138/121 |
| 3,315,704 | A | * | 4/1967 | Shire | 138/121 |
| 3,559,692 | A | * | 2/1971 | Mantelet | 138/121 |
| 3,913,623 | A | * | 10/1975 | Siegwart | 138/122 |
| 4,283,078 | A | * | 8/1981 | Ross et al. | 285/45 |
| 4,295,452 | A | | 10/1981 | Lembke et al. | |
| 4,340,089 | A | * | 7/1982 | Freiherr von Arnim et al. | 138/121 |
| 4,540,203 | A | | 9/1985 | Lambert | |
| 4,709,731 | A | | 12/1987 | Wang | |

FOREIGN PATENT DOCUMENTS

| | | |
|---|---|---|
| DE | 28 29 057 | 1/1980 |
| FR | 658 066 | 5/1929 |
| FR | 1 444 034 | 7/1966 |

* cited by examiner

*Primary Examiner*—Thomas Moulis
(74) *Attorney, Agent, or Firm*—Kenyon & Kenyon

(57) ABSTRACT

A fuel-injection system for injecting fuel into an internal combustion engine, having at least one fuel injector and a fuel-distributor line, is provided with an inflow for each fuel injector, which has a flexible section and is connectable to an inflow section of the fuel injector. The flexible section is made up of three concentric sleeve sections which radially overlap at least partially and are interconnected by bends, doubled when viewed in the axial cross section.

7 Claims, 1 Drawing Sheet

FUEL INJECTION SYSTEM

FIELD OF THE INVENTION

The present invention is based on a fuel-injection system for injecting fuel into an internal combustion engine.

BACKGROUND INFORMATION

From German Patent No. DE 28 29 057, a fuel-injection system is known which supplies fuel to a mixture-compressing internal combustion engine having external ignition as a function of operating parameters. The fuel-injection system includes a metal fuel-distributor line which is connected via at least one branch line to at least one fuel injector, the branch line being embodied as a metal tube and connected to the fuel injector by way of a threaded connection. Easily bendable metal is used as material for the branch line. Situated between the threaded connection on the branch line and the fuel injector are thin-walled metal bellows in the form of expansion bellows which compensate a lateral offset between the beginning of the branch line on the fuel-distributor line and the fitting position of the fuel injector.

Disadvantageous in the fuel-injection system known from German Patent No. DE 28 29 057 is that the expansion bellows require a minimum number of convolutions in order to compensate both for tolerances of the overall length and for tilting of the axes of the fuel injector and the beginning of the fuel-distributor line. The angle compensation (angular compensation) and the side compensation (lateral compensation) require the expansion bellows to have a minimum length.

From U.S. Pat. No. 2,014,355, a pipe connection in the form of a corrugated tube is known, which is meant to prevent, or reduce, the transmission of vibrations. On the outside, the corrugated tube is surrounded by an envelope which does not contact the corrugated tube and which is rigidly connected to the one pipe section at one end. At its other end, a flexible seal seals the envelope from the other pipe section, the envelope shielding from noise originating in the corrugated tube.

This art also has the above-mentioned disadvantages.

SUMMARY OF THE INVENTION

The fuel-injection system according to the present invention has the advantage over the related art that the inflow and the flexible section have a low overall height but nevertheless allow an angle compensation and a lateral compensation over a large area. Specifically, the compensation is achieved by elastic deformation of the flexible section itself, and there is no danger of a seal leaking over time.

Advantageously, a third sleeve section having the largest diameter is axially positioned between a first and a second sleeve section, the first sleeve section and second sleeve section having identical diameters.

Without narrowing the flow cross-section of the fuel inflow, an angle compensation and lateral compensation may be attained given low overall length.

The bends, double in the axial cross section, are advantageously embodied in s-form.

The deformation of the flexible section is evenly distributed over the region bent in an s-shape. A longitudinal compensation across a large area is made possible in an advantageous manner.

The sleeve sections and bends may be made from sheet metal.

DETAILED DESCRIPTION

Figure 1:
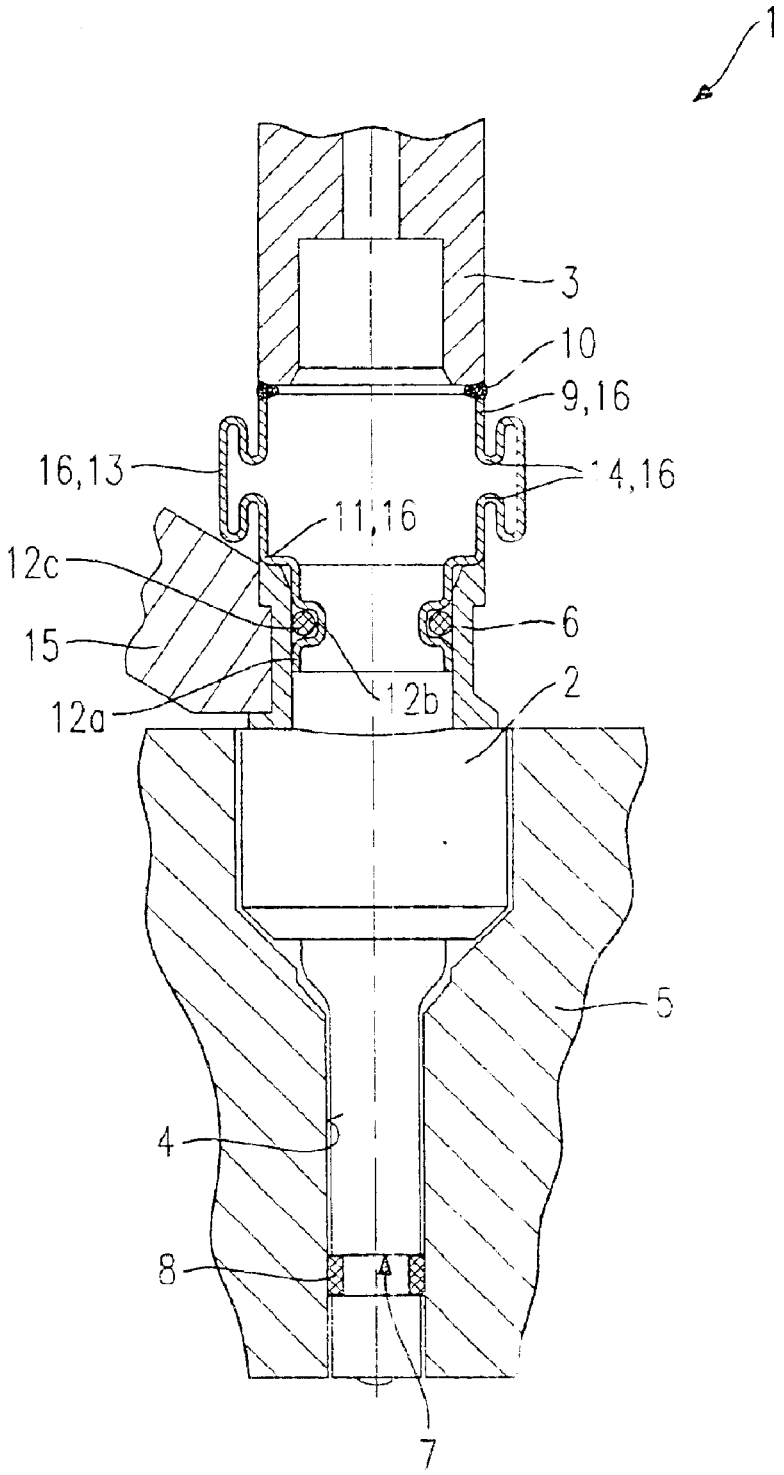
FIG. 1 shows a section through an exemplary embodiment of a fuel-injection system configured according to the present invention, in the sectional plane of a fuel injector and an inflow of a fuel-distributor line.

FIG. 1 shows an axial section through an exemplary embodiment of a fuel-injection system 1 according to the present invention, in the plane of a fuel injector 2 and an inflow 3 of a fuel-distributor line, which is not shown here. Fuel injector 2 is inserted in a bore 4 of a cylinder head 5 of an internal combustion engine and shown in a sectioned view in the area of an inflow region 6.

Fuel injector 2 is sealed from bore 4 by a sealing ring 8, made of elastomer, for instance, which is located in a groove 7.

A first sleeve section 9 is connected to inflow 3 via a welded seam 10. A second sleeve section 11 is connected to a guide section 12*a* which is inserted in inflow section 6 of fuel injector 2 and includes a groove 12*b* having a sealing ring 12*c* to seal from inflow section 6. Radially on the outside, first sleeve section 9 and second sleeve section 11 are enclosed by a third sleeve section 13. First, second and third sleeve sections 9, 11, 13 are joined via double bends 14, which have an S-shaped form in the axial cross section shown.

First sleeve section 9, second sleeve section 11, third sleeve section 13 and S-shaped bends 14 form a flexible section 16. Flexible section 16 is made from sheet metal such as spring steel.

Formed on inflow section 6 is a connecting plug 15 for the control of fuel injector 2.

Advantageously, a compensation may take place in case of a laterial deviation or tilting between inflow 3 and inflow section 6. Deviation in the clearance between inflow 3 and inflow section 6 may likewise be compensated for by deformation of flexible section 16, especially of S-shaped bends 14. Only a small overall height of flexible section 16 is required, although relatively large tolerances may be compensated for compared to the related art.

By a correspondingly rigid design of flexible section 16 it is possible for flexible section 16 to exert a holding-down force on fuel injector 2 from the fuel-distributor line, by which fuel injector 2 is held down in bore 4, counter to the combustion pressure, so that no special holding-down devices are required.

What is claimed is:

1. A fuel-injection system for injecting fuel into an internal combustion engine comprising:

at least one fuel injector having an inflow section; and a fuel-distribution line which, for each fuel injector, has an inflow including a flexible section, the inflow being connectable to the inflow section of the fuel injector, the flexible section being composed of three concentric sleeve sections which radially overlap at least partially and are interconnected by bends, doubled when viewed in an axial cross section.

2. The fuel-injection system according to claim 1, wherein a third one of the sleeve sections having a largest diameter is axially situated between a first one of the sleeve sections and a second one of the sleeve sections.

3. The fuel-injection system according to claim 2, wherein the first sleeve section and the second sleeve section have identical diameters.

4. The fuel-injection system according to claim 1, wherein the bends have an s-shape.

5. The fuel-injection system according to claim 1, wherein the sleeve sections and the bends are composed of sheet metal.

6. The fuel-injection system according to claim 1, wherein the flexible section is fixedly connected to the inflow of the fuel-distributor line.

7. The fuel-injection system according to claim 6, wherein the fixed connection between the inflow and the flexible section is obtained by welding.

* * * * *